United States Patent [19]

de Ruyter

[11] Patent Number: 4,562,609

[45] Date of Patent: Jan. 7, 1986

[54] BROOM BODY WITH ARTIFICIAL BOUGHS

[76] Inventor: Jackie A. de Ruyter, 32, Rue de la Cigale, 68200 Mulhouse, France

[21] Appl. No.: 624,587

[22] Filed: Jun. 26, 1984

[30] Foreign Application Priority Data

Jun. 30, 1983 [FR] France ..... 83 11200
Mar. 22, 1984 [FR] France ..... 84 04793

[51] Int. Cl.[4] ..... A46B 3/10

[52] U.S. Cl. ..... 15/171; 15/159 A; 15/202

[58] Field of Search ..... 15/171, 194, 168–175, 15/186, 202, 159 A

[56] References Cited

U.S. PATENT DOCUMENTS 3,651,531 3/1972 Wietelman ..... 15/171
4,031,588 6/1977 Leroy et al. ..... 15/171

FOREIGN PATENT DOCUMENTS 2482853 11/1981 France ..... 15/194

*Primary Examiner*—Peter Feldman
*Attorney, Agent, or Firm*—Emmanuel J. Lobato; Robert E. Burns; Bruce L. Adams

[57] ABSTRACT

A broom body having artificial boughs simulating natural boughs for sweeping. The body is an assembly of a tubular socket of an elastic plastic, artificial boughs and a cover sleeve also of plastic. The socket has a cylindrical portion and a portion having a frusto-conical configuration and axially spaced collars of equal dimension and thereon axially spaced. The collar outer diameters are greater than that of the socket. The boughs with a lateral ring at one end and artificial twigs axially distributed on the rod and may have connecting twigs between the longest twigs. The broom body is assembled by placing the rings of the boughs axially on the socket and sliding them axially until the individual rings are disposed circumferentially of a respective collar. The collars may each have a radial projection filtering a groove of the corresponding bough rod to preclude on the socket in a circumferential. A plastic cover sleeve is assembled over the broom body socket by slipping it axially thereon so that it fits circumferentially around the bough rings and is internally dimensioned to hold the bough rings on their corresponding collars. Locking mechanisms are provided on the socket and cover sleeve for maintaining the broom body components assembled and capable of disassembly for replacement of worn boughs.

6 Claims, 14 Drawing Figures

14
1
13
6
6
6
16
9

A
4
5
C
D
8'
8
1
2
7
3
7
6
7
6
E
F
6
B
8'
4
5
8'
8
1
2
7
6
3
7
6
7
6
7
A-B

C-D
8'
5
8'
8

6
7
E-F

A'-B'
9
10
11
12
A'
9
C'
D'
10
11
12
B'

14
15
13
16
17
14
15
13

11
10
9

C'-D'
16
13
16
14

Fig. 9
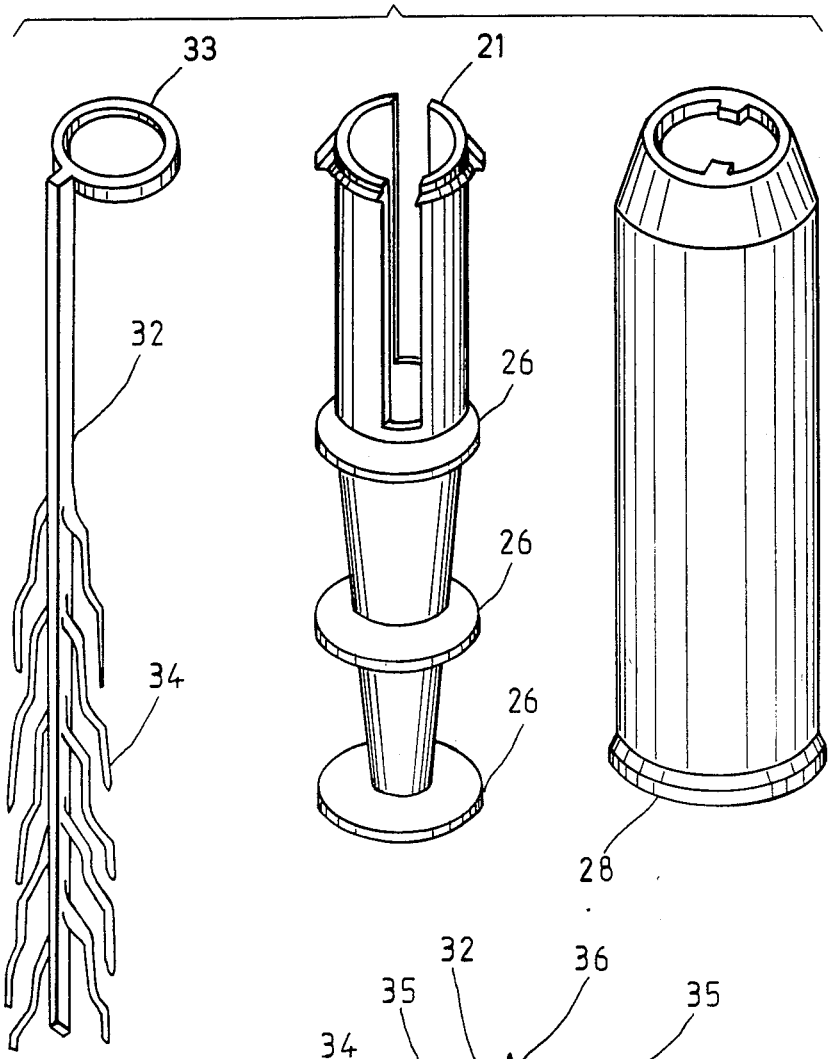
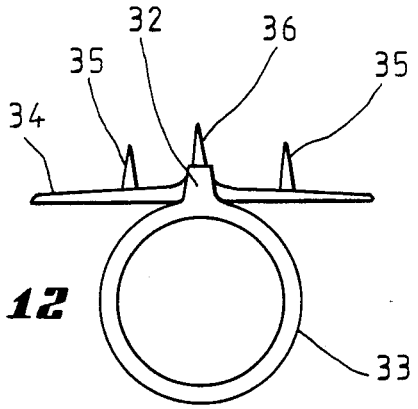
Fig. 12

BROOM BODY WITH ARTIFICIAL BOUGHS

BACKGROUND OF THE INVENTION

The present invention is relevant to plastic brooms and more particularly concerns brooms of the type imitating the roadman broom of birch or heather.

Such brooms allow a longevity decidedly longer than that of the usual broom of natural boughs, and provide the same flexibility in utility for cleaning of sidewalks, gutters, etc..

Plastic brooms offering this particularity are already known, and notably those relating to the disclosures of the French Pat. No. 69 07 121, No. 70 26 760, No. 72 22 841 and No. 75 32 093.

All the four patents aforesaid describe plastic brooms made by injection molding, and are characterized in that they comprise a group of boughs, either molded together, or joined together through transversal strips, and that are disposed around a slit tube, then covered by a bushing.

These devices show various disadvantages concerning production costs and price: in the case of boughs flatly molded for a single set with transversal strips, the cost of the mold is very important and the winding around the broom hum is difficult, because of the quality of the plastics. In the case of boughs mechanically assembled through an independent binding strip, the assembling operation is therefore longer and costlier. Moreover these devices do not allow replacing of one or several boughs without changing the bundle set. Finally the plastic brooms of this type always have the twigs of the same bough independent from each other. Taking into account the variations in the rigidity of the plastics in the process of utilization and according the ambient temperature, it is frequent that these twigs appear in certain cases ineffectual, for instance for separating wet dead leaves or oiled papers from the ground.

SUMMARY OF THE INVENTION

The present invention is directed to proposing a device or broom of the birch broom type, carried out in plastics material, and which has exceptional assembly convenience, allowing lowering the costs, and providing an increased rigidity of the twigs while keeping the quality of a plastic that is sufficiently flexible. Moreover, it is possible to change individually each bough without being obliged to replace the bundle set.

To this end, the device that is the object of this invention is characterized in that it comprises a combined set of identical and independent artifical boughs, each bough is constituted of a rod terminating in a ring in its upper part, and that bears twigs in its lower part. A tubular socket for fastening the boughs, that is constituted of a partially cylindrical and partially conical body, is hollow for axially receiving the handle, equipped with collars or discs for holding and guiding the boughs. A lid or cover in the shape of a bushing or elongated sleeve, is fitted with structure for locking of the boughs in relation to the socket body. According to a variant, which is aimed to a simplified realization of the locking of the boughs and of the cover while securing a better resistance, the head of the socket is equipped with two wide slots or channels that go down to the first guide collar or disc. A collar situated at the head of the handle socket is provided with two large projections, so as to secure the longitudinal locking of the lid or cover. The guide discs or collars are lacking in retaining projections, and the cover is equipped with two projections having shoulders on its upper cylindrical part in order to cooperate with the two wide slots or channels of the socket achieving the locking of the cover to avoid rotation thereof in relation to the socket.

Longitudinal ribs inside the cover sleeve prevent the rotation of the boughs in relation to the cover sleeve.

Ramming brackets of the bough rings are also arranged inside the cover sleeve in its upper part.

As a result from these detail modifications, it is possible to use tolerance standards that are less strict, and therefore a less costly tooling and greater ease in mounting.

BRIEF DESCRIPTION OF THE DRAWINGS

The invention is better understood by reading the detailed following description and examining the attached drawings that show, as non limiting example, these two types of embodiments according to the invention.

FIG. 9 is a perspective exploded view of three types of elements that constitute the broom in a second embodiment, that is: boughs, socket, cover.

FIG. 12 is a profile view of a bough according to the inven- tion.

DESCRIPTION OF THE PREFERRED EMBODIMENT

Figures 1, 2, 3:
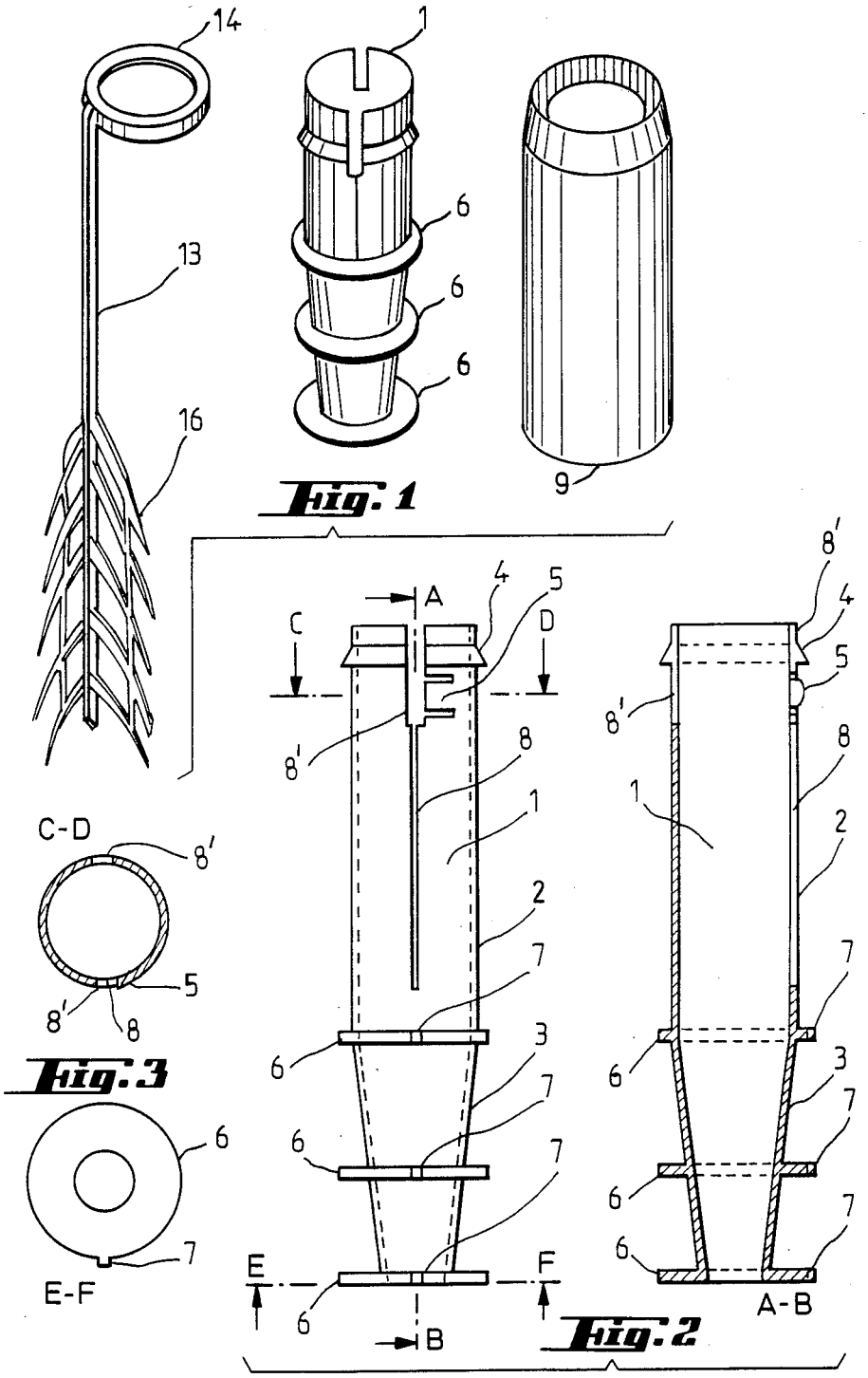
FIG. 1 is a perspective exploded view of three types of elements employed in the assemblage of the broom in a first embodiment, that is: the boughs, the socket, and the cover.
FIG. 2 illustrates the fastening socket of the boughs, in an elevation view and according to section AB.
FIG. 3 illustrates the sections CD and EF of FIG. 2.
Figures 4, 5, 6, 7, 8:
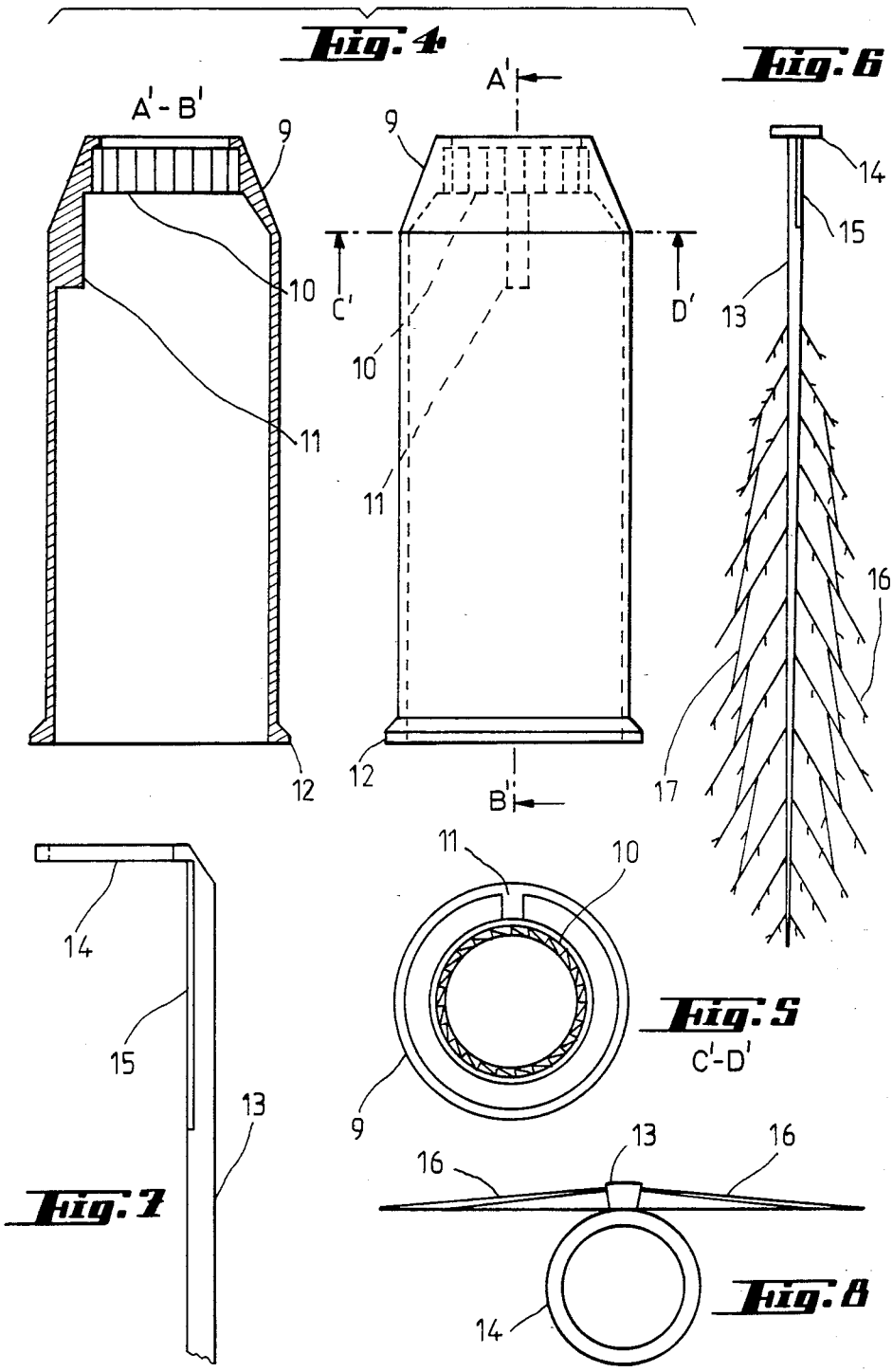
FIG. 4 illustrates an elevation view of the locking lid and according to the section A'B'.
FIG. 5 is a section C'D ' of FIG. 4.
FIG. 6 is a profile view of a bough.
FIG. 7 is a lateral view of a bough head.
FIG. 8 is a top view of the bough.

When referring firstly to FIGS. 1 and 8, it is seen that according to FIG. 2, a fastening socket of the boughs is constituted of a hollow plastic body that allows housing of the lower end of the broom handle. This socket is cylindrical in its upper part 2, and lightly conical in its lower part 3, so as to prevent the handle broom sliding therethrough. The cylindrical part 2 is limited at the top by a collar 4, effective to retain the locking cover sleeve, a pawl 5, arranged under the collar 4, cooperates with a tooth crown fitted in the locking lid or cover sleeve.

The conical part 3 bears several guide collars or discs 6 whereof the first retains the first bough in the axial direction, and whereof the set keeps the bundle of boughs cylindrical and uniformly disposed, while compensating for the conicity of the lower part of the socket. A projection 7 is arranged on each guide collar 6, so as to limit any rotation of the boughs relative to the socket 1.

The cylindrical part of the socket 2 is slit in a longitudinal direction by a slot 8. This slot 8 is wider and enlarged in its upper end 8'.

FIG. 3, illustrating sections CD and EF of FIG. 2, gives prominence in section DC to the pawl 5 arranged under the retaining collar 4 of the cover sleeve, just as to the elasticity slots 8 and 8'. In section EF is seen the projection 7 arranged on the collars 6.

FIG. 4 illustrates details of the locking cover sleeve 9, constituted of a bushing or sleeve that is smooth on the outside. The internal upper part is provided with a toothed crown 10 and a locking projection shoulder 11. The external lower part can be reinforced by an overthickness of plastic 12, so as to increase the strength of this zone.

FIG. 5 illustrates the section C'D' of FIG. 4, gives prominence to the profile in same slope of the toothed crown 10, also the locking shoulder or projection 11.

According to FIG. 6, one of the boughs is seen, constituted of a rod 13, which has a profile like a sector of a crown and gets thinner downwards. The upper part is terminated by a ring 14, perpendicular to the rod 13. A notch 15 is arranged on a side of the bough, just under the ring 14, so as to compensate for the extent of the projections 7 that are fitted on the socket 1 at the level of the collars 6.

The twigs 16 are disposed on the rod 13 of the bough and they are joined by connections between them such as at level 17 for the longest of them.

In FIG. 7 is seen detail of the rod head 13, with the perpendicular ring 14 and the groove or notch 15 for receiving the projections 7.

FIG. 8 shows a top view of a bough, with the fastening ring 14, the twigs 16 and the rod 13 whereof the profile illustrates in the upper part a sector of a crown, so that the juxtaposition of boughs fills exactly the space situated between the socket 1 and the cover sleeve 9.

The elements so constituted are easily assembled in a broom body as follows:

The operator sets the socket 1 on a mounting gauge constituted of a vertical rod fitted with a stop for retaining the socket, then slips on in a successive order and in circumferential displacement, the boughs 13 that are juxtaposed. The first bough 13 rests at the level of the ring 14 on the first disc guide or collar 6, and is locked in rotation in relation to the socket 1, owing to the projection 7 arranged on the collars 6. The second bough is wedged axially and locked in rotation similarly to the preceeding bough on its ring.

Taking into account the profile of the rod of the boughs 13, that shows a sector, when the last bough is set up, the set of rods 13 forms a bush in a spiral around the socket 1, and the last bough set up is juxtaposed with the first.

It is sufficient to put a cover circumferentially over the set with the locking cover sleeve 9. The cover is slit axially downwards, the set of boughs is fixed at the level of their respective rings 14, and the cover sleeve 9 is locked axially on the socket. The locking against rotation of the boughs 13 in relation to the socket is accomplished by turning the cover 9 clockwise, so that the shoulder or projection 11 rams the boughs 13 which are locked in rotation at the level of the first set bough, on the projections 7 of the guide collars 6.

The toothed crown 10 of the lid cooperates with the pawl 5 arranged on the socket 1, so as to prevent any counter clockwise back-return circumferentially of the locking cover sleeve.

The unlocking of the assembly remains possible if the broom handle is not inserted in the socket 1. Indeed it is possible to squeeze manually the head of the socket 1, that is allowed by means of the double slots 8', so that the cover sleeve 9 gets over the collar 4 of the socket. The assembly being freed from the cover sleeve, it is possible to remove each bough according to the same process of assembly described.

When the handle is inserted into the socket, it tends to force the socket 1 to open which makes impossible any unlocking of the assembled device.

Referring to FIGS. 9 to 12, it is seen that, in this second embodiment, also, a socket 21 is cylindrical in its upper part 22, and lightly conical in its lower part 23, so as to prevent a broom handle sliding therethrough. The cylindrical part 22 is limited at top by a collar 24, effective to retain the locking cover sleeve, and two wedges 25, arranged on the collar 24, reinforce locally the means of locking.

The conical part 23 has several guide collars 26, the first of which axially retains the first bough in the axial direction, and the set of which holds the bundle cylindrical and uniform, while compensating the conicity of lower part of the socket.

Contrary to the first embodiment previously described, the guide discs or collars 26 are lacking in projections that lock from rotation the boughs in relation to the socket.

The cylindrical part 22 of the socket 21 is provided with two wide longitudinal slots or channels 27. These slots 27 are disposed diametrally opposite each other.

Figure 10A:
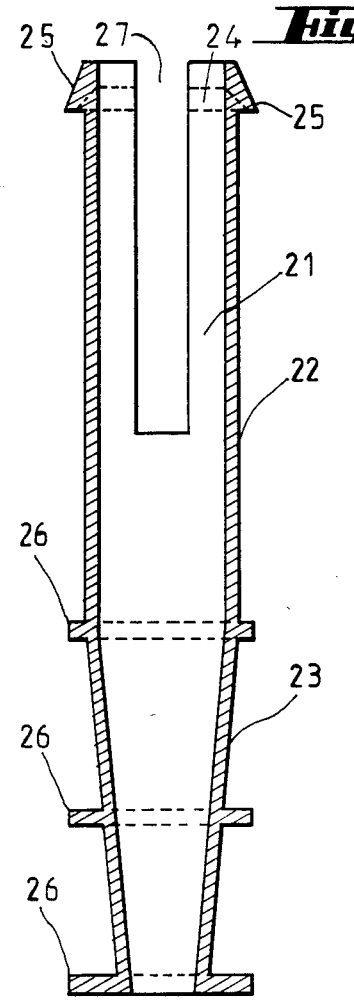
FIGS. 10(*a*) and 10(*b*) illustrate respectively a section and a top view of the socket.
Figure 10B:
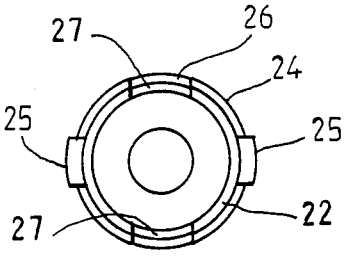

FIG. 10(*b*) shows a top view of the socket 21 and gives prominence to the cylindrical part 22, the collar 24 and its two reinforcing wedges 25 diametrally opposite, destined for locking the same as the two slots or channels 27, that are also diametrally opposite and set perpendicularly to the wedges 25.

Figure 11A:
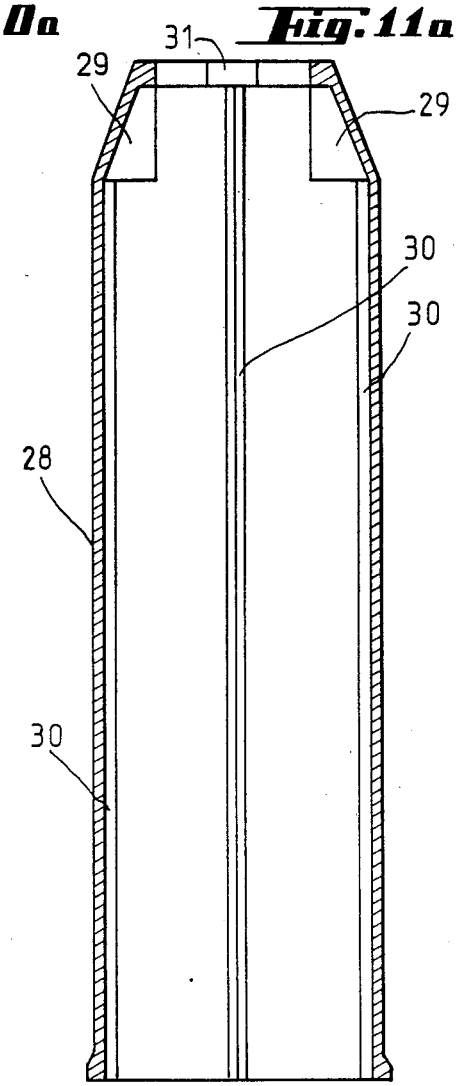
FIGS. 11(*a*) and 11(*b*) illustrate respectively a section and a bottom view of the lid.
Figure 11B:
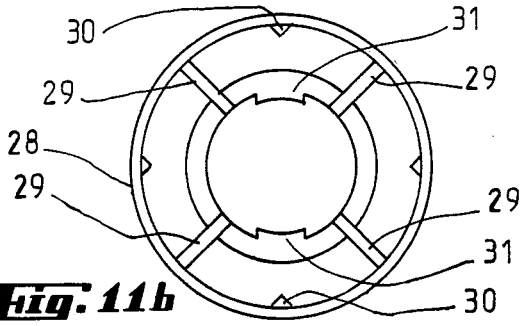

FIG. 11 gives the detail of the locking cover 28, constituted as a profiled bushing in its upper part. The internal upper part is provided with ramming brackets or projections 29, destined to retain the boughs and are at least three so as to lock them uniformly circumferentially spaced. These projections have a triangular section as shown.

The external lower part of the cover sleeve can be reinforced by an overthickness of plastic so as to increase the strength of this section.

The upper opening of the cover, which has a circular form and comes to be set on the socket, is equipped with two projections 31 blocking rotation.

FIG. 11(*b*) that is a bottom view, shows the cover sleeve 28, the guiding projections of the boughs 30, the ramming projections 29, and the projections blocking the rotation of the cover sleeve.

According to the FIG. 12, one of the boughs is seen that is constituted of a rod 32, which has a profile of triangular shape and gets thinner downwards. The upper part is terminated by a ring 33 that is perpendicular to the rod 32.

The twigs 34 for sweeping are arranged on the central rod 32 of the bough.

The head of the rod 32 is lacking in twigs in the zone that must be covered by the cover sleeve.

Some sweeping twigs 34 receive small clamp twigs 35 placed in a plane downwardly inclined in relation to the plane of the sweeping twigs.

Two or three clamp twigs 36 are also placed on the lower part of the central rod 32, in a plane inclined upwards in relation to the plane of the sweeping twigs 34.

The parts so constituted are easily assembled in a broom body assembly as follows:

The operator sets the socket 21 on a mounting gauge comprising a vertical rod provided with a stop so as to retain the socket, then he slips on in a successive order the boughs 22, varying judiciously their distribution circumferentially around the socket and making slide the rings 13 on the socket 21.

The first bough rests at level of its ring 33 on the first guide disc 26. The second bough comes to its guide collar 26 with its ring circumferentially thereof.

The width of each of the rods 22 is calculated so that the stacking of all the boughs bring them about to forming a spiral or fluted arrangement around the socket 21.

The boughs can be stacked in a spiral or in a different circumferential arrangement.

When the last bough is set up, it is sufficient to put the cover sleeve 28 while making it slide axially downwards on the set of the heads of the boughs placed on the socket.

The guide ribs 30 of the boughs are set in the flutes obtained by juxtaposition of the rods of the boughs and are of triangular cross section, so that these ones are not able to turn in relation to the cover sleeve.

By lowering completely the cover sleeve 28 onto the socket 21, it is possible to position the projections 31 in the channels 27 arranged on the head of the socket.

The final locking is obtained when the head of the cover sleeve gets over the collar 24 and the two wedges 25 situated in the head of the socket.

The details of this locking allow the locking of the boughs in relation to the cover sleeve, and the locking of the cover sleeve in relation to the socket.

The unlocking of the device remains possible if the broom handle is not inserted into the socket 21. Indeed it is sufficient to squeeze manually the head of the socket, that is made possible by the two slots or channels 17, so that the lid 28 gets over the collar 24 and the two wedges 25 of the socket.

When the lid is removed, it is possible to take out each bough according to the same process of insertion.

When the handle is inserted in the socket, it tends to force the socket 21 to open which makes impossible any unlocking in rotation and longitudinal movement.

The present invention has the advantage of a broom construction, of the type of a birch broom, that is made entirely of plastics, at a very competitive cost and price, taking into account the simplified mounting operations.

On the other hand, the clamp twigs secure the boughs being caught between them, which contributes to the homogeneity of the bundle.

The disassembly of the set and the interchangeability of the boughs allow the replacement of one or several boughs, thus the most worn out boughs can be replaced.

Finally, the locking mechanism allows improvement of the mounting time and the use of an injection mold, that is not very costly since less strict tolerances are possible on the mold dimensions.

I claim:

1. A broom body for a broom with artificial boughs comprising, an elongated tubular socket for receiving a broom handle axially therein, the socket having on a cylindrical part thereof two longitudinal slots for defining two half-shells capable of being elastically brought circumferentially closer, the socket having a portion in the shape of a truncated cone with three collars disposed axially spaced on said portion, said collars each having an outer diameter greater than the outer diameter of the socket, a plurality of similar artificial elements each configured and dimensioned similar to a bough with twigs thereon and each having a lateral ring at one thereof, the rings being disposed in assembly on the socket circumferentially of a corresponding collar, the artificial boughs being spaced circumferentially from each other on the socket, and an elongated cover sleeve having a length at least approximately that of the socket and removably mounted in use in assembly circumferentially of the socket and said rings spaced axially on the socket, and the cover sleeve having an internal dimension for effectively removably holding said rings on the respective collars to effectively hold said boughs in place assembled on the socket.

2. A broom body according to claim 1, in which the socket comprises adjacent an end rim thereof a circumferentially disposed collar wedge-shaped in cross section having a diameter increasing gradually in a direction away from said end, the outer diameter of the last-mentioned collar having an inner diameter approximately that of the inner diameter of the rings to allow slipping of said rings axially on the last-mentioned collar by elastic deformation and contraction thereof to their initial diameter circumferentially on the collars to hold them in place on said respective collars.

3. A broom body according to claims 1 or 2, in which said cover sleeve has a part gradually decreasing in diameter and a part having an internal diameter approximately equal to the outer diameter of the rings of the boughs for effectively holding the rings clamped on the respective collars on the socket on which said rings are circumfererentially disposed thereby holding the boughs in position on the socket when the cover sleeve is assembled axially on the socket circumferentially thereof with the boughs assembled on the socket.

4. A broom body according to claim 1, in which said cover sleeve has inwardly extending projections received in said slots thereby precluding rotation of the cover sleeve relative to the socket.

5. A broom body according to claim 1, in which said cover sleeve comprises internal longitudinal ribs spaced circumferentially for effectively keeping the boughs on the socket spaced circumferentially.

6. A broom body according to claim 5, in which one of said ribs comprises a shoulder for holding said rings axially.

* * * * *